US009801460B2

(12) United States Patent
Lim

(10) Patent No.: US 9,801,460 B2
(45) Date of Patent: Oct. 31, 2017

(54) RETRACTABLE COSMETIC IMPLEMENT WITH MULTIPLE POSITIONS

(71) Applicant: HCT Group Holdings Limited, Santa Monica, CA (US)

(72) Inventor: Cindy Sean Yuei Lim, Santa Monica, CA (US)

(73) Assignee: HCT Group Holdings Limited, Hong Kong (HK)

( * ) Notice: Subject to any disclaimer, the term of this patent is extended or adjusted under 35 U.S.C. 154(b) by 839 days.

(21) Appl. No.: 14/071,420

(22) Filed: Nov. 4, 2013

(65) Prior Publication Data

US 2015/0121638 A1 May 7, 2015

(51) Int. Cl.

| | |
|---|---|
| ***A46B 7/02*** | (2006.01) |
| ***A46B 9/02*** | (2006.01) |
| ***A46B 17/04*** | (2006.01) |

(52) U.S. Cl.

CPC ..... *A46B 7/026* (2013.01); *A46B 7/023* (2013.01); *A46B 9/021* (2013.01); *A46B 17/04* (2013.01)

(58) Field of Classification Search

CPC ..... A45D 40/264; A46B 7/044; A46B 9/021; A46B 9/10; A46B 7/023

See application file for complete search history.

(56) References Cited

U.S. PATENT DOCUMENTS

| | | | |
|---|---|---|---|
| 544,452 | A | 8/1895 | Young et al. |
| D27,690 | S | 9/1897 | Waite |
| 715,881 | A | 12/1902 | Scott |
| 783,937 | A | 2/1905 | Edwards et al. |
| 987,277 | A | 3/1911 | Wright |
| 1,142,698 | A | 6/1915 | Grove et al. |
| 1,185,617 | A | 6/1916 | Blaha et al. |
| 1,190,227 | A | 7/1916 | Fesler |

(Continued)

FOREIGN PATENT DOCUMENTS

| | | | |
|---|---|---|---|
| CN | 1196212 | A | 10/1998 |
| CN | 201192160 | Y | 2/2009 |

(Continued)

OTHER PUBLICATIONS

The PCT Search Report and Written Opinion mailed on Dec. 26, 2014 for PCT application No. PCT/US2014/056233, 10 pages.

(Continued)

*Primary Examiner* — Randall Chin

(74) *Attorney, Agent, or Firm* — Seager, Tufte & Wickhem LLP

(57) ABSTRACT

A retractable cosmetic implement may be movable between multiple different use positions. In one example, the cosmetic implement may include a housing elongated along a longitudinal axis, a multi-stop positioning mechanism disposed within the housing, an applicator coupled to the positioning mechanism at a first end of the housing, and a push-button for engaging the positioning mechanism, the push-button disposed at a second end of the housing. By actuating the positioning mechanism, the applicator may move through an opening to a partially extended position and/or a fully extended position from a retracted position. The applicator may have a material characteristic, such as a density of bristles, affected by its position relative to a rim of the opening applying a force against the applicator.

21 Claims, 6 Drawing Sheets

(56) References Cited

U.S. PATENT DOCUMENTS 1,242,956 A 10/1917 Lewyt
1,261,502 A 4/1918 Farrows
1,355,026 A 10/1920 Austin
1,429,823 A 9/1922 Allison
1,457,615 A 6/1923 Bunker
1,480,814 A 1/1924 Bright et al.
1,486,957 A 3/1924 England
1,501,835 A 7/1924 Bash
1,508,306 A 9/1924 Strulson
1,510,898 A 10/1924 Nikicser
1,527,052 A 2/1925 McAndrews
1,563,031 A 11/1925 Jones
1,586,332 A 5/1926 Vinton
1,651,355 A 12/1927 Alland
1,666,116 A 4/1928 Bunnell
1,748,491 A 2/1930 May
1,748,895 A 2/1930 Jordan
1,831,393 A 11/1931 Pierce, Jr.
1,864,874 A 6/1932 Voight
1,889,496 A 11/1932 Priest
1,899,242 A 2/1933 Mcnab
1,914,240 A 6/1933 Caldwell
1,938,442 A 12/1933 Stuart
1,972,532 A 9/1934 McMillan
2,104,651 A 1/1938 Hoffman, Jr.
2,132,943 A 10/1938 Frazier
2,141,531 A 12/1938 Graham
2,199,154 A 4/1940 Frohnert
2,262,753 A 11/1941 Brennan
D134,797 S 1/1943 Lubkin
2,442,051 A 5/1948 Luscri
2,485,822 A 10/1949 Goldrich
2,533,838 A 12/1950 Ranft
D165,691 S 1/1952 Macomic
2,584,735 A 2/1952 Pancoast
2,590,329 A 3/1952 Kromray
2,591,537 A 4/1952 Gordon
2,622,256 A 12/1952 Vojacek
2,637,060 A 5/1953 Cowan
2,637,868 A 5/1953 Hamilton
2,642,331 A 6/1953 Sprinkle
2,701,378 A 2/1955 Reinbolt et al.
2,736,051 A 2/1956 Boodakian
2,797,886 A 7/1957 Pinckney
2,874,399 A 2/1959 Solomon
2,946,072 A 7/1960 Filler et al.
2,982,983 A 5/1961 Peterson
2,997,210 A 8/1961 Mackirdy
3,007,188 A 11/1961 Dolan
3,106,738 A 10/1963 Bohne
3,170,265 A 2/1965 Goldfarb
3,193,863 A 7/1965 Myers et al.
3,205,523 A 9/1965 Seaver
D205,127 S 6/1966 Dykes
3,291,130 A 12/1966 Whitehead
3,309,728 A 3/1967 Seaver
3,353,203 A 11/1967 Ginter
3,472,242 A 10/1969 Demner
3,495,858 A 2/1970 Kindel
3,505,700 A 4/1970 Rodriguez
3,531,814 A 10/1970 Safalow
3,577,582 A 5/1971 Aston
3,592,202 A 7/1971 Jones
3,712,749 A 1/1973 Roberts
3,863,288 A * 2/1975 Aversa ..... A46B 7/023 15/184
3,867,299 A 2/1975 Rohatgi et al.
3,884,635 A 5/1975 Sloan et al.
3,908,676 A 9/1975 Levine et al.
3,951,157 A 4/1976 Idec
3,955,670 A 5/1976 Buslik et al.
4,088,413 A 5/1978 Rossignol de la Ronde et al.
D249,600 S 9/1978 Bowman
4,129,918 A 12/1978 Lee et al.
D251,159 S 2/1979 Tolliver
4,140,222 A 2/1979 Francavilla
4,165,942 A 8/1979 Johansson
4,187,607 A 2/1980 Simuro et al.
4,203,431 A 5/1980 Abura
4,204,294 A 5/1980 Halverson
4,213,472 A 7/1980 Gueret et al.
D258,241 S 2/1981 Takada et al.
4,248,543 A 2/1981 Carrington et al.
4,267,851 A 5/1981 Plaisted
4,292,986 A 10/1981 Ergaver et al.
4,381,159 A 4/1983 Payne
D269,481 S 6/1983 Souza
4,396,238 A 8/1983 Torruella
4,479,047 A 10/1984 Khaja et al.
4,483,036 A 11/1984 Sayklay
4,502,497 A 3/1985 Siahou et al.
D278,951 S 5/1985 Kalinsky
4,545,393 A 10/1985 Gueret et al.
4,600,328 A 7/1986 Clements
4,617,948 A 10/1986 Gueret
4,681,791 A 7/1987 Shibahashi et al.
4,727,618 A 3/1988 Mahoney et al.
4,734,953 A 4/1988 Dodson
D296,005 S 5/1988 Alkire
D297,889 S 10/1988 Ries et al.
4,776,456 A 10/1988 Lewis
4,778,300 A 10/1988 French et al.
4,869,612 A 9/1989 Mooney et al.
4,898,193 A 2/1990 Gueret et al.
4,917,132 A 4/1990 Tuchman
4,929,108 A 5/1990 Gueret
D311,455 S 10/1990 Snipes
4,987,911 A 1/1991 Powers
5,007,442 A 4/1991 Hirzel et al.
5,052,839 A 10/1991 Pettengill
5,056,179 A 10/1991 Capponi
D325,264 S 4/1992 Shinohara
5,107,984 A 4/1992 Welschoff
5,109,877 A 5/1992 Takeda
D328,366 S 7/1992 Villani
5,134,747 A 8/1992 Roesler et al.
5,137,038 A 8/1992 Kingsford
5,153,066 A 10/1992 Tanaka et al.
5,176,754 A 1/1993 Hirzel
5,211,494 A 5/1993 Baijnath et al.
5,220,702 A 6/1993 Howell et al.
D339,235 S 9/1993 Hirzel
5,301,695 A 4/1994 Wong
5,316,513 A 5/1994 Nakagawa et al.
5,330,056 A 7/1994 De La Rocha
5,333,343 A 8/1994 Nichols et al.
5,334,421 A 8/1994 McNutt
5,339,483 A 8/1994 Byun et al.
5,348,031 A 9/1994 Cloud
5,388,599 A 2/1995 Yen et al.
5,431,176 A 7/1995 Favre et al.
5,447,167 A 9/1995 Fleischaker
5,480,027 A 1/1996 Leonard
5,480,038 A 1/1996 Collier
5,482,059 A 1/1996 Miraglia
5,484,065 A 1/1996 Davoli
5,491,865 A 2/1996 Gueret
5,507,063 A 4/1996 Hirsch
5,535,474 A 7/1996 Salazar
5,573,019 A 11/1996 Hempel
5,588,447 A 12/1996 Gueret
D377,121 S 1/1997 Lee
5,596,785 A 1/1997 Park
5,603,340 A 2/1997 Gueret
5,617,884 A 4/1997 Allison
5,620,270 A 4/1997 Gueret
5,628,082 A 5/1997 Moskovich et al.
5,630,505 A 5/1997 Garcia
D380,615 S 7/1997 Roberts
5,713,471 A 2/1998 Gueret
5,765,252 A 6/1998 Carr
5,778,479 A 7/1998 Raia
5,799,910 A 9/1998 Dexter et al.
5,802,658 A 9/1998 Ward

(56) References Cited

U.S. PATENT DOCUMENTS 5,839,626 A 11/1998 Gross et al.
5,881,742 A 3/1999 Hunsberger
D408,636 S 4/1999 Gadling
5,896,614 A 4/1999 Flewitt et al.
5,896,866 A 4/1999 Quennessen
5,941,254 A 8/1999 Heler
5,957,604 A 9/1999 Anderson
5,960,745 A 10/1999 Boyland
5,960,802 A 10/1999 Sakai
5,970,989 A 10/1999 Litton et al.
5,974,618 A 11/1999 Dumler et al.
5,976,616 A 11/1999 Celia
6,024,101 A 2/2000 Garner et al.
6,026,824 A 2/2000 Gueret
D421,846 S 3/2000 Choe
6,039,051 A 3/2000 Dorf
D422,916 S 4/2000 Herrmann
6,070,597 A 6/2000 Motherhead
6,070,749 A 6/2000 Joulia
6,074,076 A 6/2000 Parrish
6,119,891 A 9/2000 Favre
6,138,686 A 10/2000 Yuhara
6,145,151 A 11/2000 Herron et al.
6,158,443 A 12/2000 Leman et al.
6,173,719 B1 1/2001 Petit
6,180,741 B1 1/2001 Yamaguchi et al.
6,186,324 B1 2/2001 Catterson
6,189,697 B1 2/2001 Davis
D439,415 S 3/2001 Mink et al.
6,199,694 B1 3/2001 Van Diest et al.
6,202,242 B1 3/2001 Salmon et al.
6,202,902 B1 3/2001 Starr
6,224,287 B1 5/2001 Gieux
6,226,828 B1 * 5/2001 Lin ..... A46B 7/026 15/184
6,234,181 B1 5/2001 Lou
6,241,203 B1 6/2001 Cukrov
6,254,996 B1 7/2001 Fukuda et al.
6,264,147 B1 7/2001 Mitchell
6,268,040 B1 7/2001 McArthur
6,269,515 B1 8/2001 Varma
D448,178 S 9/2001 Tapley et al.
6,283,298 B1 9/2001 Seidler
6,298,863 B1 10/2001 Byun
6,309,124 B1 10/2001 Gueret
D450,189 S 11/2001 Mink et al.
D450,930 S 11/2001 Mink et al.
D450,931 S 11/2001 Mink et al.
6,311,358 B1 11/2001 Soetewey et al.
6,312,182 B1 11/2001 Dumler
D451,681 S 12/2001 Mink et al.
6,336,460 B2 1/2002 Yuhara
6,342,167 B1 1/2002 Kawano et al.
D454,001 S 3/2002 Mink et al.
6,354,308 B1 3/2002 Kuk
6,357,944 B1 3/2002 Reed et al.
6,371,420 B1 4/2002 Strunk
D458,134 S 6/2002 Berish et al.
6,401,290 B1 6/2002 Barton et al.
6,405,402 B1 6/2002 Choi
6,418,939 B1 7/2002 Byun
6,438,784 B1 8/2002 Yu
6,497,236 B1 12/2002 Yates et al.
6,505,402 B2 1/2003 Moriwake et al.
6,506,327 B2 1/2003 Weihrauch
D471,018 S 3/2003 Mink
6,532,970 B2 3/2003 Phue
D472,462 S 4/2003 Atkin et al.
6,546,937 B2 4/2003 Gueret
D474,342 S 5/2003 Silvestri
D475,536 S 6/2003 Vaes
6,588,958 B1 7/2003 Seidler
6,596,203 B1 7/2003 Au et al.
6,601,591 B1 8/2003 Carullo et al.
D479,917 S 9/2003 Mink
D479,918 S 9/2003 Mink
D480,218 S 10/2003 Mink
6,669,389 B2 12/2003 Gueret
D485,442 S 1/2004 Twigg
6,706,775 B2 3/2004 Hermann et al.
6,712,076 B2 3/2004 Alexander et al.
6,761,969 B2 7/2004 Li et al.
6,831,541 B1 12/2004 Seidler
6,832,405 B1 12/2004 Miller
6,866,046 B2 3/2005 Gueret
6,880,197 B2 4/2005 Katz et al.
6,890,115 B2 5/2005 Le Moing
6,895,628 B1 5/2005 Anderson
6,898,818 B2 5/2005 Lin
6,942,412 B2 9/2005 Gueret
6,957,468 B2 10/2005 Driesen et al.
7,004,913 B1 2/2006 Rutenberg et al.
7,007,797 B1 3/2006 Ruccolo
7,073,902 B2 7/2006 Codos et al.
7,096,598 B1 8/2006 Myatt
D527,529 S 9/2006 Ajluni et al.
D528,305 S 9/2006 Langer
7,107,645 B2 9/2006 Bressler et al.
7,111,354 B2 9/2006 Nennig et al.
D529,292 S 10/2006 Langer
7,127,770 B2 10/2006 Clegg et al.
7,140,061 B2 11/2006 Baker et al.
7,159,950 B2 1/2007 Young-Chul
7,228,864 B2 6/2007 Tahara
7,234,474 B2 6/2007 Byun
7,246,400 B2 7/2007 Ryan
7,261,483 B2 8/2007 Gueret
D549,964 S 9/2007 Roth et al.
D550,562 S 9/2007 Yew
D551,569 S 9/2007 Tanaka
7,275,885 B2 10/2007 Byun
7,316,045 B2 1/2008 Koke
D562,005 S 2/2008 King
D562,566 S 2/2008 Mink
7,334,685 B2 2/2008 Mathiez
7,337,787 B2 3/2008 Matsuoka
7,344,327 B2 3/2008 Gueret
D566,969 S 4/2008 Sherman et al.
D568,050 S 5/2008 Huang
D568,740 S 5/2008 Williams
D571,105 S 6/2008 Godin
D572,585 S 7/2008 Perrin et al.
7,416,358 B2 8/2008 Legendre
D577,911 S 10/2008 Liebers
D578,773 S 10/2008 Sherman et al.
D580,177 S 11/2008 Louis-Jeune
7,448,111 B2 11/2008 Bigio
7,465,113 B2 12/2008 Gueret
D584,513 S 1/2009 Sherman et al.
D584,897 S 1/2009 Belley
7,494,030 B2 2/2009 Bennett
D589,665 S 3/2009 Kwapis
7,530,752 B2 5/2009 Gueret
D598,655 S 8/2009 Thorpe et al.
7,581,544 B2 9/2009 Gueret
D601,803 S 10/2009 Reishus et al.
D601,804 S 10/2009 Hwang
7,653,960 B2 2/2010 Lee
D612,615 S 3/2010 Chitayat et al.
7,716,775 B2 5/2010 DiPietro et al.
D616,743 S 6/2010 Cresswell et al.
D616,744 S 6/2010 Cresswell et al.
7,727,634 B2 6/2010 Yacovone
D620,798 S 8/2010 Cresswell et al.
D621,258 S 8/2010 Gullickson et al.
7,766,440 B2 8/2010 Kusunoki
D623,371 S 9/2010 Li
D626,338 S 11/2010 Ajootian
7,824,124 B2 11/2010 Francavilla et al.
7,832,564 B2 11/2010 Kim
7,854,562 B2 12/2010 Peterson et al.
7,866,758 B2 1/2011 Jang
D632,488 S 2/2011 Twigg
7,882,949 B1 2/2011 Singh

(56) References Cited

U.S. PATENT DOCUMENTS

| | | | |
|---|---|---|---|
| 7,895,696 | B2 | 3/2011 | Belmonte |
| 7,895,698 | B2 | 3/2011 | Mink |
| 7,918,620 | B2 | 4/2011 | Del Ponte |
| D637,404 | S | 5/2011 | Wang |
| 7,950,402 | B1 | 5/2011 | Cole |
| 7,955,014 | B2 | 6/2011 | Thorpe et al. |
| 7,996,947 | B2 | 8/2011 | Gueret |
| D646,487 | S | 10/2011 | Leppla et al. |
| 8,032,972 | B2 | 10/2011 | Cherry |
| 8,061,518 | B2 | 11/2011 | Shaughness |
| 8,074,666 | B2 | 12/2011 | Piao |
| 8,074,796 | B1 | 12/2011 | Andrews |
| D651,409 | S | 1/2012 | Papenfu |
| 8,104,132 | B2 | 1/2012 | Mink |
| D654,375 | S | 2/2012 | Kuboshima |
| 8,117,707 | B1 | 2/2012 | Ruh, II |
| 8,132,285 | B2 | 3/2012 | Piao |
| 8,132,541 | B1 | 3/2012 | Baer, Jr. |
| 8,136,536 | B2 | 3/2012 | Bickford |
| 8,141,561 | B2 | 3/2012 | Thorpe et al. |
| D658,385 | S | 5/2012 | Lim et al. |
| D658,389 | S | 5/2012 | Salgatar |
| 8,184,998 | B2 | 5/2012 | Morikuni |
| 8,185,993 | B2 | 5/2012 | Fischer et al. |
| 8,185,998 | B2 | 5/2012 | Xu |
| 8,220,100 | B2 | 7/2012 | Diamond |
| 8,220,469 | B1 | 7/2012 | Spagnuolo |
| 8,226,319 | B2 | 7/2012 | Francavilla et al. |
| 8,230,543 | B2 | 7/2012 | Shrier et al. |
| 8,256,058 | B2 | 9/2012 | Telwar |
| D669,213 | S | 10/2012 | Celia |
| 8,286,790 | B1 | 10/2012 | McBryar |
| 8,292,529 | B2 | 10/2012 | Francavilla |
| 8,321,987 | B2 | 12/2012 | Bagley |
| 8,360,078 | B2 | 1/2013 | Lim et al. |
| D675,829 | S | 2/2013 | Jakubow |
| 8,371,549 | B1 | 2/2013 | Paquette |
| 8,393,037 | B2 | 3/2013 | Iwahori et al. |
| 8,402,592 | B2 | 3/2013 | Byrne et al. |
| D681,342 | S | 5/2013 | Brower |
| 8,522,973 | B2 | 9/2013 | Joseph |
| 8,595,886 | B2 | 12/2013 | Edelstein et al. |
| 8,657,107 | B2 | 2/2014 | Gabbard |
| 8,678,693 | B2 | 3/2014 | Sturgis et al. |
| D707,390 | S | 6/2014 | Bunkley |
| 8,752,559 | B1 | 6/2014 | Tsai |
| D717,548 | S | 11/2014 | Lim |
| D727,034 | S | 4/2015 | Lewis |
| D727,567 | S | 4/2015 | Bunkley |
| 2001/0003600 | A1 | 6/2001 | Guay |
| 2002/0040720 | A1 | 4/2002 | Byun |
| 2002/0078902 | A1 | 6/2002 | Ehrmann |
| 2002/0148058 | A1 | 10/2002 | Greenwood et al. |
| 2002/0162565 | A1 | 11/2002 | Sebban |
| 2002/0164192 | A1 | 11/2002 | Gueret |
| 2003/0005533 | A1 | 1/2003 | Woodnorth et al. |
| 2003/0035953 | A1 | 2/2003 | Weihrauch |
| 2003/0066151 | A1 | 4/2003 | Chang |
| 2003/0089673 | A1 | 5/2003 | Herren |
| 2003/0110585 | A1 | 6/2003 | Rechelbacher |
| 2003/0135945 | A1 | 7/2003 | Nordstrom |
| 2004/0050732 | A1 | 3/2004 | Baker |
| 2004/0129580 | A1 | 7/2004 | Cochran |
| 2004/0134009 | A1 | 7/2004 | Sander et al. |
| 2004/0163193 | A1 | 8/2004 | Stafford |
| 2004/0237996 | A1 | 12/2004 | Fischer |
| 2005/0011030 | A1 | 1/2005 | Gonzalez |
| 2005/0138747 | A1 | 6/2005 | Su et al. |
| 2005/0198759 | A1 | 9/2005 | Segrea |
| 2005/0249539 | A1 | 11/2005 | Habatjou |
| 2005/0273962 | A1 | 12/2005 | Dillon |
| 2006/0000729 | A1 | 1/2006 | Ceballos |
| 2006/0075570 | A1 | 4/2006 | Gelfand |
| 2006/0150355 | A1 | 7/2006 | Mason et al. |
| 2006/0162736 | A1 | 7/2006 | Gray |
| 2006/0223024 | A1 | 10/2006 | Hochman |
| 2006/0260078 | A1 | 11/2006 | Ranks |
| 2007/0080094 | A1 | 4/2007 | Moon |
| 2007/0113364 | A1 | 5/2007 | Zen |
| 2007/0124882 | A1 | 6/2007 | Lee |
| 2007/0151061 | A1 | 7/2007 | Mink et al. |
| 2007/0151571 | A1 | 7/2007 | Byun |
| 2007/0206986 | A1 | 9/2007 | Gueret |
| 2007/0261710 | A1 | 11/2007 | Son et al. |
| 2007/0295351 | A1 | 12/2007 | Germer |
| 2008/0060665 | A1 | 3/2008 | Umeno et al. |
| 2008/0078419 | A1 | 4/2008 | Hirst |
| 2008/0213719 | A1 | 9/2008 | Giniger et al. |
| 2008/0243179 | A1 | 10/2008 | Ziv |
| 2008/0256725 | A1 | 10/2008 | Emge |
| 2008/0256733 | A1 | 10/2008 | Brown |
| 2008/0276396 | A1 | 11/2008 | Lucero |
| 2008/0309017 | A1 | 12/2008 | Mattice |
| 2009/0003917 | A1 | 1/2009 | Duncan |
| 2009/0039995 | A1 | 2/2009 | Kipp et al. |
| 2009/0044357 | A1 | 2/2009 | Chan et al. |
| 2009/0054925 | A1 | 2/2009 | Cho |
| 2009/0071499 | A1 | 3/2009 | Wyatt et al. |
| 2009/0071502 | A1 | 3/2009 | Drugeon |
| 2009/0089949 | A1 | 4/2009 | Mink et al. |
| 2009/0090375 | A1 | 4/2009 | Tran |
| 2009/0097899 | A1 | 4/2009 | Carroll |
| 2009/0119863 | A1 | 5/2009 | Gallegos |
| 2009/0131977 | A1 | 5/2009 | Ross |
| 2009/0183328 | A1 | 7/2009 | King |
| 2009/0194127 | A1 | 8/2009 | Pires et al. |
| 2009/0194129 | A1 | 8/2009 | Junemann |
| 2009/0200184 | A1 | 8/2009 | Cullen |
| 2009/0211939 | A1 | 8/2009 | Cho |
| 2009/0260172 | A1 | 10/2009 | Weiss |
| 2009/0272399 | A1 | 11/2009 | Kim |
| 2010/0001541 | A1 | 1/2010 | Sugiyama |
| 2010/0017990 | A1 | 1/2010 | Piao |
| 2010/0037407 | A1 | 2/2010 | Telwar |
| 2010/0043815 | A1 | 2/2010 | Levy et al. |
| 2010/0059080 | A1 | 3/2010 | Gueret |
| 2010/0095973 | A1 | 4/2010 | Shrier et al. |
| 2010/0163071 | A1 | 7/2010 | Everett, Jr. et al. |
| 2010/0324594 | A1 | 12/2010 | Mercanti |
| 2011/0056505 | A1 | 3/2011 | Parkinson et al. |
| 2011/0083690 | A1 | 4/2011 | Cardenas et al. |
| 2011/0116857 | A1 | 5/2011 | Carroll et al. |
| 2011/0174823 | A1 | 7/2011 | Silva |
| 2011/0198453 | A1 | 8/2011 | Volk |
| 2011/0198454 | A1 | 8/2011 | Volk |
| 2011/0266297 | A1 | 11/2011 | Thorpe et al. |
| 2011/0315161 | A1 | 12/2011 | Lim et al. |
| 2012/0017930 | A1 | 1/2012 | Nance |
| 2012/0054971 | A1 | 3/2012 | Dugan |
| 2012/0159731 | A1 | 6/2012 | Liu et al. |
| 2012/0204899 | A1 | 8/2012 | Uehara et al. |
| 2012/0260931 | A1 | 10/2012 | Martin et al. |
| 2012/0272982 | A1 | 11/2012 | Telwar et al. |
| 2012/0294666 | A1 | 11/2012 | Jang |
| 2012/0295216 | A1 | 11/2012 | Dykes et al. |
| 2012/0298130 | A1* | 11/2012 | Telwar ..... A46B 3/08 132/317 |
| 2012/0312315 | A1 | 12/2012 | Gueret |
| 2013/0017010 | A1 | 1/2013 | Liu |
| 2013/0111683 | A1 | 5/2013 | Lim et al. |
| 2013/0199556 | A1 | 8/2013 | Lim |
| 2014/0014659 | A1 | 1/2014 | Thorpe et al. |
| 2014/0023689 | A1 | 1/2014 | Kim et al. |
| 2014/0154295 | A1 | 6/2014 | Sim et al. |
| 2014/0219701 | A1 | 8/2014 | Eberlein |
| 2014/0259489 | A1 | 9/2014 | Dale |
| 2014/0325775 | A1 | 11/2014 | Nakamura et al. |
| 2014/0331422 | A1 | 11/2014 | Lim |
| 2014/0332027 | A1 | 11/2014 | Lim |

FOREIGN PATENT DOCUMENTS

| | | | |
|---|---|---|---|
| CN | 201308219 | Y | 9/2009 |
| CN | 201399985 | Y | 2/2010 |

(56) References Cited

FOREIGN PATENT DOCUMENTS

| | | | |
|---|---|---|---|
| CN | 301313366 | S | 8/2010 |
| CN | 201610006 | U | 10/2010 |
| CN | 101884463 | A | 11/2010 |
| CN | 301542018 | S | 5/2011 |
| CN | 202588745 | U | 12/2012 |
| CN | 302457092 | S | 6/2013 |
| DE | 2111893 | A1 | 9/1972 |
| DE | 3232227 | A1 | 3/1984 |
| DE | 4215896 | C1 | 11/1993 |
| DE | 29713124 | U1 | 9/1997 |
| DE | 29807245 | U1 | 6/1998 |
| DE | 10038850 | A1 | 2/2002 |
| EP | 2084986 | A2 | 8/2009 |
| EP | 2301379 | A1 | 3/2011 |
| FR | 2464674 | A | 3/1981 |
| FR | 2642283 | A1 | 8/1990 |
| FR | 2976463 | A | 12/2012 |
| JP | 2003033228 | A | 2/2003 |
| JP | 2003135140 | A | 5/2003 |
| JP | 2004041260 | A | 2/2004 |
| JP | 1218834 | S | 10/2004 |
| JP | 2007068945 | A | 3/2007 |
| JP | 1343552 | S | 11/2008 |
| JP | 2009172300 | A | 8/2009 |
| KR | 200262437 | A | 3/2002 |
| KR | 300365471 | S | 10/2004 |
| KR | 300404554 | S | 1/2006 |
| KR | 200432010 | Y1 | 11/2006 |
| KR | 300525977 | S | 9/2008 |
| KR | 30-0607863 | S | 8/2011 |
| KR | 30-0672266 | S | 3/2012 |
| KR | 30-0681633 | S | 11/2012 |
| WO | 9211785 | A1 | 7/1992 |
| WO | 2007117091 | A1 | 10/2007 |
| WO | 2009031851 | A2 | 3/2009 |
| WO | 2010098997 | A1 | 9/2010 |

OTHER PUBLICATIONS

"All for One, Full Magnetic Travel Brush Set", Sephora, retrieved on Feb. 26, 2015 at <<http://www.sephora.com/aa-for-one-full-magnetic-travel-brush-set-P387815>>, 3 pages.

Amazon: L'Oreal Brow Stylist Professional 3-in-1 brow tool; retrieved on Jun. 27, 2013 at: http://www.amazon.com/Loreal-Brow-Stylist-Professional-Blonde/dp/B001KYo7AY, 5 pages.

Benjabelle, "Mini Brush Tree" retrieved on Sep. 1, 2014 at <http://www.benjabelle.com/collections/brush-trees/product/mini-brush-tree>>, 3 pages.

"Brushegg", retrieved on Oct. 23, 2014 at <<http://brushegg.bigcartel.com/product/brushegg>>, 2 pages.

"Brush Cleaning Glove", Sigma Spa, retrieved on Oct. 16, 2014 at <<http://www.sigmabeauty.com/Sigma_Spa_Brush_Cleaning_Glove_p/bc001.htm>>, 2 pages.

"Car Wash Brushes," Martin Cox Chamois Ltd, retrieved on Oct. 16, 2014 at <<http://www.martincoxchamois.com/flow_through_car_wash_brushes.html>>, 8 pages.

"Clarisonic" retrieved on Dec. 19, 2013 at <<http://www.clarisonic.com/>>5 pages.

CN 3412782 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412783 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412785 Registered Design, (Tianjin Samsun Brushes Ltd.) Dec. 22, 2004, [online], [retrieved on Oct. 3, 2014] Retrieved from the Questel Intellectual Property Portal Design Database using the Internet: <URL: http://www.orbit.com>.

CN 3417893 Registered Design, (Tianjin Samsun Brushes Ltd.) Jan. 12, 2005, [online], [retrieved on Oct. 3, 2014] Retrieved from the Questel Intellectual Property Portal Design Database using the Internet: <URL: http://www.orbit.com.

CN 3466155 Registered Design, (Tianjin Samsung Brushes Ltd.) Aug. 10, 2005 [online], [retrieved on Aug. 26, 2014] Retrieved from the Questel Intellectual Property Portal Design Database Using the Internet: <URL; http://www.orbit.com>.

Da Vinci Catalog, Novelties 2005-2008, © Jan. 2008 [online], Top-point Mix B series 5535 Brushes, [retrieved on Mar. 13, 2015]. Retrieved from the Internet: <URL: http://www.davinci-defect.com>.

"Dual Interchangeable Brush Set", Global Market, retrieved on Mar. 18, 2015 at <<http://www.glabalmarket.com/product-info/dual-interchangeable-brush-set-468011.html>>, 2 pages.

Ebay: L'Oreal Brow Stylist Professional 3-in-1 brow tool; retrieved on Jun. 27, 2013 at: http://www.ebay.com/itm/Loreal-Brow_Stylist-3-in-1-Tool-Tweezer-Pencil-Brush-/360388299897; 3 pages.

Everbluec Singapore Beauty Makeup and Skincare Blog, May 14, 2011 [online], Elizabeth Arden makeup blender, [retrieved on Mar. 14, 2015] Retrieved from the Internet: http://everbluec.com/2011/05/ceramide-colors-exclusive-launch-at.html>.

"Fingermax Creative Finger Painting Paint Brush", retrieved on Oct. 9, 2014 at ,,http://thesotre.com/fingermax-creative-finger-painting-paint-brush/TSHVY6X6YF>>, 5 Pages.

Foam Finger Wax Applicator, retrieved on Nov. 6, 2014 at <<http://www.cleanyourcar.co.uk./accessories/foam-finger-waxapplicators-pkg/2/prod_633.html>>, 2 pages.

"Furbuster 3 in 1 Dog Grooming Glove", Petmate 89801, retrieved on Oct. 16, 2014 at <<Furbuster 2 in 1 Dog Grooming>>, 6 pages.

"Givenchy Demesure Audacious Lashes Mascara," May 17, 2011, retrieved from the internet at <<ttp://www.fashionizers.com/perfumes-makeup/givenchu-demesure-audacious-lashes-mascara/>>, 9 pages.

Givenchy Parfums Maquillage, Soins, Parfums, retrieved on May 14, 2010 at <<http://www.parfumsgivenchy.com/make_up/collections/2010_summer_collection/products_in_this_collection/le_prisme_yeux_island_camaieu_limited_edition/product_5_183_1128_214.html>> 1 page.

Givenchy Summer Makeup Collection 2010 Review and Swatches, retrived on May 14, 2010 at <<http://www.musingsofamuse.com/2010/04/givenchy-summer-makeup-collection-2010-review-and-swatches.html>> 20 pages.

Indeutsch May 2003 [online], Hobby & Craft Brushes, Series HCS: Squirrel Mop, p. 2, [retrieved on Jun. 30, 2014] Retrieved from the Internet using Web Archive: URL:<http://web.archive.org/web/*/http://www.indeutsch.com>.

"iTech Magnetic & Tourmaline Boar and Nylon Bristle Brush 3 1/4 Inch", Beauty Encounter Inc.[retrieved on Sep. 9, 2010] <http://www.beautyencounter.com/727428765006.html>.

Lady Zona, "Choosing the Right Make Up Brush", Retrieved on Feb. 24, 2015 at <<http://www.ladyzona.com/choosing-the-right-make-up-brush/>>, 3 pages.

"Latest design double end kabuki blush brush", Alibaba.com, retrieved on Mar. 18, 2015 at <<http://www.alibaba.com/product-detail/Latest-design-double-end-kabuki-blush_668701458.html>>, 3 pages.

"Launch Pad Mojo Magpro Professional Magnetic Brush Set", Beauty and the Blog, retrieved on Feb. 26, 2015 at <<http://www.beautyandblog.com/2012/01/launch-pad-mojo-magpro-professional.html, 4 pages.

LeKeux, "My Cosmetic Range" LeKeux HQ, retrieved on Feb. 24, 2015 at <<http://lekeuxhq.blogspot.com/2014/11/my-cosmetics-range.html>>, 6 Pages.

Little Blue Chairs, "My first Giveaway at Little Blue Chairs!" Retrieved on Apr. 10, 2013 at <<http://www.littlebluechairs.com/2011/02/my-first-giveaway-at-little-blue-chairs.html>> 8 pages.

"Makeup Brushes Buying Guide", Ebay, Jun. 9, 2014, retrieved on Mar. 18, 2015 at <<http://www.ebay.com/gds/Makeup-Brushes-Buying-Guide-/100000000177404992/g.html>>, 6 pages.

"MelodySusie", retrieved on Oct. 9, 2014 at <<http://amazon.com/MelodySusie-Apllicatior-Milti-Functional-Vibration-Foundation/

(56) References Cited

OTHER PUBLICATIONS dp/B00B4QGM1A/ref=aag_m_pw_dpie=UTF8&m=A24IL96TV4XLBY>>, 4 pages.
Moddea, retrieved on Oct. 16, 2014 at <<http://moddea.com/2012/10/>>, 15 pages.
Nixon, "Optometric Office", retrieved on Oct. 9, 2014 at <<http://www.optometricoffice.com?OO/OO-Archive/BIGGER-IS-BETTER-3436.aspx>>, 2 pages.
"Non Optional UK Beauty and Lifestyle Blog", posted by Nicola Surrey, retrieved on Jan. 9, 2015 at <<http://non-optional.blogspot.com/2012_08_01_archive.html>>, Aug. 2012 {2012}, Sephora classic Mineral Powder Brush, p. 16, 24 pages.
"Popcorn Yubi-fude Finger Brush", Japan Trend Shop, retrieved on Oct. 8, 2014 at <<http://www.japantrendshop.com/popcorn-yubifude-finger-brush-p-939.html>>, 3 pages.
"Series of innovations for makeup brushes", Premium Beauty Media, retrieved on Feb. 26, 2015 at <<http://www.premiumbeautynews.com/en/Series-of-innovations-for-make-up,3232>>, 2 pages.
"Silicone Blackhead Cleanser Nose Pore Brush Cleaner Remover Finger Tool", retrieved on Oct. 9, 2014 at <<Silicone Blackhead cleanser Nose Pore Brush cleaner Remover Finger Tool>>, 2 pages.
"Silicone Nose Pore Clean Finger Brush Blackhead Extractor Remover Facial Scrub Pad Tool", retrieved on Oct. 9, 2014 at <<http://www.alibaba.com/produckt-detail/Silicone-Nose_Pore-Clean-Finger-Brush_900763337.html>>.9 pages.
"Teeth Brushing for cats and dogs", retrieved on Oct. 9, 2014 at <<Teeth Brushing for cats and dogs>>, 7 pages.
The Brush Guard; http://www.thebrushguard.com/ retrieved Oct. 25, 2011, 1 page.
"The Makeup Bullet" retrieved on Oct. 9, 2014 at <<http://themakeupbullet.com/>>, 1 page.
Wholesale-mn-2 Pcs Portable Cosmetics Telescopic Lip, retrieved on Oct. 16, 2014 at <<http://www.dhgate.com/product/wholesale-mn-2-pcs-portable-cosmetics-telescopic/200881505.html#s1-2-1|2462569649>>, 7 pages.
"Why Didn't We Think of That: Magnetic Makeup Brush", Gloss Daily, retrieved on Feb. 26, 2015 at <<http://www.glossdaily.com/blogs/glossdaily/2012/05/31/magnetic-makeup-brush/>>, 2 pages.

* cited by examiner

RETRACTABLE COSMETIC IMPLEMENT WITH MULTIPLE POSITIONS

BACKGROUND

A typical cosmetic brush contains a handle and an applicator attached to one end of the handle. This combination of a handle and an applicator provides a simple, low-cost and effective brush for the application of cosmetic materials.

Cosmetic brushes can vary greatly in size, shape, and type of applicator in order to meet the differing needs of cosmetic users and cosmetic products. For instance, some cosmetic brushes have an applicator comprised of bristles loosely bundled together at an end giving the applicator a soft, fluffy characteristic. These applicators are useful for delicately applying loose powders (e.g., foundation, blush, etc.) for sheer and light applications to areas of the face. Other cosmetic brushes have bristles more tightly bundled together at an end giving the applicator a firmness suitable for applying cosmetic products that require precision, e.g., contouring eye shadow.

With the immense variety of cosmetic products currently on the market, users often carry multiple brushes, each corresponding to a specific use and/or cosmetic product. This increases the cost to the user and adds clutter to their carrying bag, purse, bathroom, and the like.

Accordingly, there remains a need for improved cosmetic brushes.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1A:
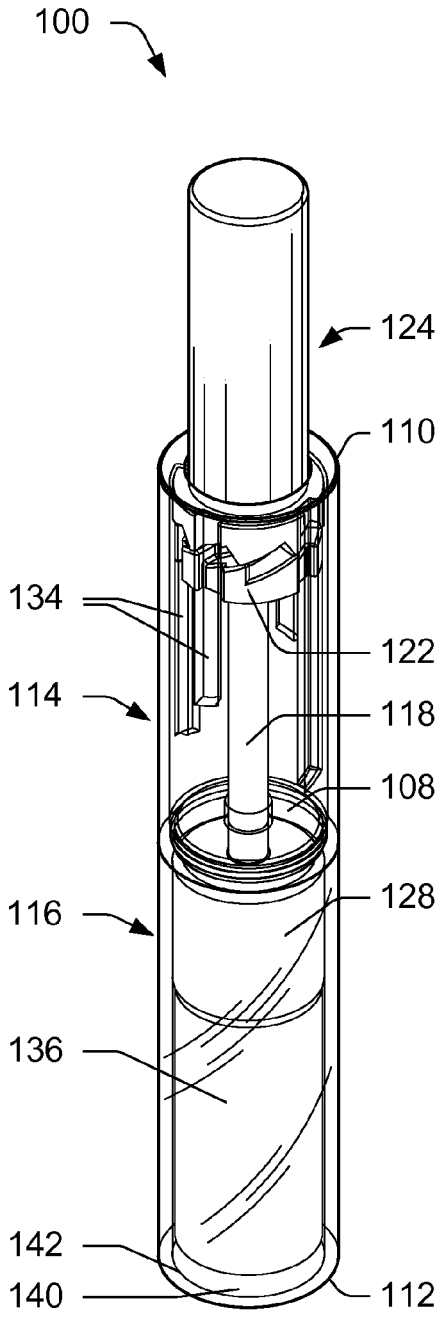
FIG. 1A is a perspective view of an example retractable cosmetic implement with a housing, the housing being shown as transparent for ease of explanation.

As discussed above, the shortcomings of existing cosmetic brushes is often a source of inconvenience and expense for cosmetic brush users. Users require a specific brush for each type of cosmetic product and/or desired effect, resulting in users carrying an assortment of brushes in a cluttered purse or carrying bag. The cost of maintaining such a collection can quickly add up. Also, brushes that include a cap for protecting the applicator portion become extremely vulnerable to damage when the cap is lost, as often happens.

This disclosure is directed to a retractable cosmetic implement that is movable to multiple positions. The cosmetic implement is multi-functional, in that a single applicator may be used for multiple effects and/or products depending on which position it is in. The disclosed cosmetic implement may not require a cap because, in some examples, the applicator may have a position fully retracted into a housing. Many other advantages are discussed herein.

In some examples, this disclosure describes a retractable cosmetic implement comprising a housing, a multi-stop positioning mechanism disposed in the housing and an applicator coupled to the positioning mechanism at a first end of the housing. In some embodiments, the positioning mechanism may resemble, at least in principle, a click-pen mechanism commonly used in retractable pens. That is, the positioning mechanism may partially translate a longitudinal force imparted by a button into a rotational force, which both moves a protuberance (in the case of a retractable pen, the pen tip) through an opening and rotates it into an indexed position. For instance, the positioning mechanism may have a top surface configured to engage a push-button extending from a second end of the housing. When the push-button is actuated, the positioning mechanism may slide along a longitudinal axis of the housing, extending the applicator out the first end. As noted above, the cosmetic implement may be capable of providing protection to the applicator when the applicator is retracted into the housing, such that a cap is not required.

In some embodiments, the cosmetic implement may be actuated to a first, partially extended position with the applicator extended a first distance from an opening of the housing and a second, fully extended position with the applicator extended a second distance from the opening, the second distance being greater than the first distance. In the partially extended position, a rim of the opening may make contact with the applicator, applying a compressive force to an outer perimeter of the applicator. The applicator may have a material characteristic affected by the compressive force. For instance, the applicator may comprise a plurality of bristles which are compacted by the compressive force. The compacted bristles may have a firmness suitable for applying one type of cosmetic product. When the applicator is fully extended, the bristles may fully exit the opening and expand. In the fully extended position, the bristles may be loose and uncompacted with a softness suitable for applying a second type of cosmetic product. In some examples, the retractable cosmetic implement may be useful to perform the functions of multiple brushes configured for different cosmetic products and/or to apply different cosmetic effects, thereby alleviating clutter.

In some examples, the retractable cosmetic implement may comprise a positioning mechanism similar to the click-pen mechanism described above with a shaft coupled to a ferrule at a first end and coupled to a disk at a second end. The disk may have multiple channels formed onto a side surface. The channels may be configured to mate with guide rails protruding from an internal surface of the housing. When actuated by the push-button, the disk may slide along the guide rails. The push-button may be configured to provide a rotational force to the disk, causing it to rotate once it reaches the end of the guide rails. The ends of the guide rails may mate with a stop surface on the disk, locking it into a partially extended or fully extended position, depending on a length of the guide rails. Another actuation of the push-button may free the stop surface from the end of the guide rails, causing the disk to rotate and the guide rails to engage the channels, sliding the positioning mechanism back to a retracted position.

Multiple and varied example implementations and embodiments are described throughout. However, these examples are merely illustrative and other implementations and embodiments of a retractable cosmetic implement with multiple positions may be implemented without departing from the scope of the disclosure. For instance, the implementations, or portions thereof, may be rearranged, combined, used together, omit one or more portions, be omitted entirely, and/or may be otherwise modified to arrive at variations on the disclosed implementations.

Illustrative Retractable Cosmetic Implement

Figure 1B:
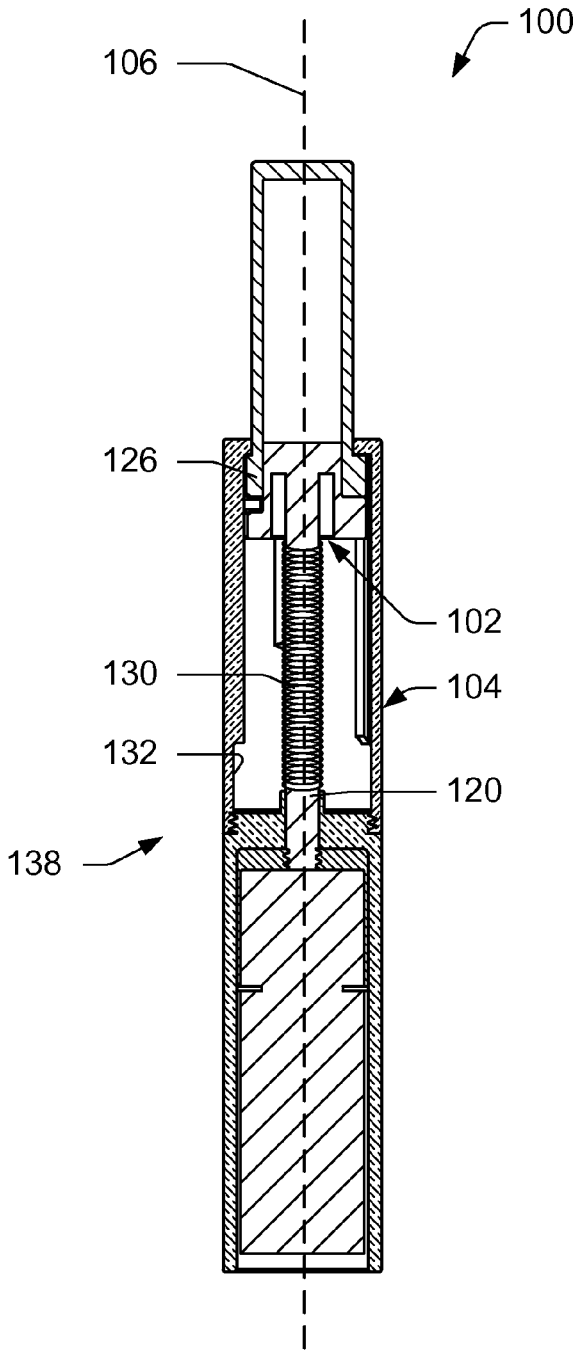
FIG. 1B is a cross-sectional elevation view of an example retractable cosmetic implement including a spring.

FIGS. 1A and 1B illustrate an example retractable cosmetic implement 100 comprising a multi-stop positioning mechanism 102 disposed inside a housing 104. In some examples, the housing 104 may be elongated along a longitudinal axis 106 and have a circular cross section, giving the housing 104 a cylindrical shape. However, in other examples, the housing 104 may have other cross-sectional shapes (e.g., oval, square, triangle, etc.). The housing 104 may include a partition 108 disposed between a first end 110 and a second end 112 of the housing 104. The partition 108 may divide the housing 104 into a first chamber 114 and a second chamber 116. In some examples, the first chamber 114 may house one or more linkages or actuation mechanisms, while the second chamber 116 may house an applicator.

The positioning mechanism 102 may be disposed inside the housing 104 with a shaft 118 extending from a first end 110 of the housing through an aperture 120 in the partition 108. The shaft 118 may be centrally located within the housing 104 along the longitudinal axis 106. In some embodiments, the positioning mechanism 102 may comprise a disk 122. The disk 122 may be coupled at its center to the shaft 118 near the first end 110 of the housing 104. The disk 122 may be configured to engage a push-button 124 or other type of actuator (e.g., lever, switch, knob, slider, etc.). The push-button 124 may extend away from the first end 110 of the housing 104 with a bottom portion 126 at least partially disposed in the housing 104. The positioning mechanism 102 may include a ferrule 128 coupled to the shaft 118 near the second end 112 of the housing 104. A spring 130 may be disposed around the shaft 118, abutting the partition 108 at a first end and abutting the disk 122 at a second end. In some embodiments, the spring 130 may be disposed in the shaft 118.

In some examples, the shaft 118, the disk 122, and/or the ferrule 128 may have a circular cross section. The shaft 118 and/or the ferrule 128 may have a diameter dimension substantially the same as an inner diameter dimension of the housing 104, such that the disk 122 and/or the ferrule 128 fits snugly into the housing 104, abutting an internal surface 132 of the housing 104. The shaft 118 may have a diameter dimension substantially less than the inner diameter dimension of the housing 104 to pass through the aperture 120 on the partition 108.

In some embodiments, a portion of the positioning mechanism 102 including the disk 122 may be disposed in the first chamber 114 and a portion of the positioning mechanism 102 including the ferrule 128 may be disposed in the second chamber 116. The shaft 118 may be at least partially disposed in both chambers 114 and 116 and may slide between the chambers 114 and 116 through the aperture 120 when the positioning mechanism 102 is actuated, as described in greater detail below.

In some examples, the cosmetic implement 100 may comprise a plurality of guide rails 134 disposed on the internal surface 132 of the housing 104. The plurality of guide rails 134 may terminate at the first end 110 of the housing and may extend towards the second end 112, parallel with the longitudinal axis 106. The plurality of guide rails 134 may engage with the push-button 124 and/or the positioning mechanism 102 to guide an actuation of the positioning mechanism 102, as described in greater detail below.

In some embodiments, the ferrule 128 may couple an applicator 136 to the positioning mechanism 102. The applicator 136 may be coupled with the ferrule 128 via an adhesive, crimp, compression fitting, friction fitting, a fastener, and/or any other coupling means. In some examples, the applicator 136 and the ferrule 128 may comprise a single component while in other examples they may comprise separate components. In other examples, the applicator 136 may be coupled to the shaft 118 without the ferrule 128.

In some examples, the applicator 136 may be enclosed in the second chamber 116 when the cosmetic implement 100 is in a retracted position 138, as illustrated in FIGS. 1A and 1B. The second chamber 116 may have an opening 140 at the second end 112 of the housing through which the applicator 136 may protrude when the positioning mechanism 102 is actuated. The opening 140 may have a rim 142 comprised of an outer edge of the housing 104. In other examples, the rim 142 may comprise a protrusion protruding inwardly from the internal surface 132 of the housing, slightly inset from the opening 140 (not shown).

Figure 2:
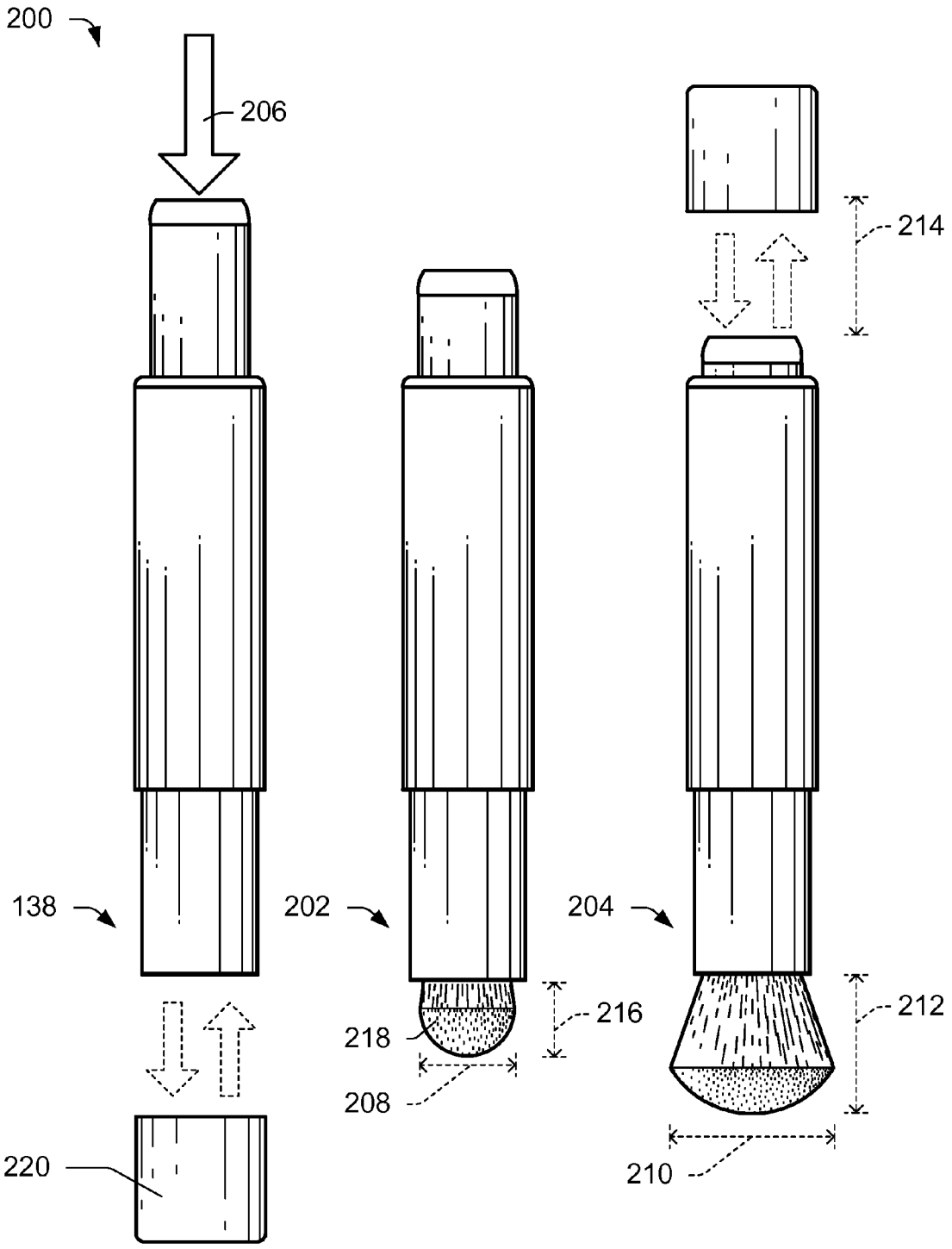
FIG. 2 is s a schematic showing a sequence of views of an example retractable cosmetic implement in a retracted position, a partially extended position, and a fully extended position.

FIG. 2 illustrates an example cosmetic implement 200 in the retracted position 138, a partially extended position 202, and a fully extended position 204. In some examples, the implement 200 may be movable from the retracted position 138 to one of the partially extended position 202 or the fully extended position 204 by imparting a force 206 parallel to the longitudinal axis 106 onto the push-button 124, actuating the positioning mechanism 102. When the implement 200 is in the partially extended position 202, the applicator 136 may be partially extended through the opening 140, such that the rim 142 of the opening 140 makes contact with the applicator 136, applying a compressive force against an outer perimeter of the applicator 136.

In some embodiments, the applicator 136 may have a material characteristic. In some examples the applicator 136 may comprise a brush with synthetic and/or natural bristles and the material characteristic may be a density of bristles. The density of bristles may affect a firmness, an absorbance, a lateral dimension 208, and/or many other properties of the applicator 136. In some examples, the applicator 136 may comprise a sponge, a flocking, a silicone member, and/or combinations thereof. In such examples, the material characteristic may be a density of applicator material, which may affect the properties of the applicator 136 as described above with regard to the density of bristles.

In some examples, the force applied by the rim 142 of the opening 140 against the applicator 136 when the implement 200 is in the partially extended position 202 may affect the material characteristic of the applicator 136. For instance, the applicator 136 may have the lateral dimension 208 that is less than a lateral dimension 210 of the applicator 136 when the implement 200 is in the fully extended position 204. As noted above, the applicator 136 may have a firmness, an absorbance, or other property affected by a compactness of applicator material responsive to the force applied by the rim 142.

In some embodiments, the positioning mechanism 102 may be actuated, moving the implement 200 into the fully extended position 204. In the fully extended position 204, the applicator 136 may be moved along the longitudinal axis 106 until it is disposed outside the housing 104. The applicator 136 may move a fully extended length 212 corresponding to an actuation length 214 that the push-button 124 is displaced. In some examples, the applicator 136 may have a portion still disposed in the housing 104 when the implement is in the fully extended position 204 such that one of the material characteristics of the applicator 136 is responsive to the force applied by the rim 142, as noted above with regard to the partially extended position 202. In such examples, the term "fully extended" refers to the fact that the applicator 136 has reached a maximum extension, even if it is still partially disposed in the housing 104. In other examples, the applicator 136 may be fully disposed outside the housing 104 when in the fully extended position 204 such that the rim 142 does not make contact with the applicator 136.

In some examples, the fully extended length 212 of the applicator 136 in the fully extended position 204 may be substantially double (e.g., 2:1) a partially extended length 216 of the applicator 136 in the partially extended position 202. In other examples, the ratio of the fully extended length 212 to the partially extended length 216 may be 1.25-to-1; 1.5-to-1; 3-to-1; 4-to-1 or any other ratio that causes a material characteristic to change between the partially extended position 202 and the fully extended position 204. As discussed in greater detail below with regard to FIG. 6, the ratio of the fully extended length 212 to the partially extended length 216 may be at least partly determined by a configuration of the plurality of guide rails 134. In some examples, there may be more than one partially extended position 202.

In some examples, the applicator 136 may comprise a plurality of bristles 218. When the implement 200 is in the partially extended position 202, the plurality of bristles 218 may be compacted by the compressive force applied by the rim 142. As such, the lateral dimension 208 and the firmness of the applicator 136 may be suitable for certain cosmetic applications, such as applying a cosmetic product for contouring. The implement 200 may be actuated to the fully extended position 204. In the fully extended position, the lateral dimension 210 of the applicator 136 may be greater than the lateral dimension 208 of the applicator 136 when the implement 200 is in the partially extended position 202. The applicator 136 may be softer when in the fully extended position 204. In the fully extended position 204, the applicator 136 may be suitable for cosmetic applications different than when the implement 200 is in the partially extended position 202, such as applying a cosmetic product for blending. In some examples, the cosmetic implement 200 may be capable of multiple cosmetic applications due to varying material characteristics corresponding to varying positions of the applicator 136.

In some embodiments, the implement 200 may comprise a cap 220. The cap 220 may be positionable over the opening 140 of the housing 104. The cap 220 may be held in place via a friction fit, snap-fit, screw-type mechanism, magnets, combinations thereof, or any other removable fastening method. In some examples, the cap 220 may be positionable over the push-button 124 using any of the aforementioned fastening methods. When positioned over the opening 140, the cap 220 may provide a barrier to prevent dirt, debris, or other foreign objects from entering the housing 104 and potentially damaging the applicator 136. In some examples, a flapper (not shown) communicatively coupled to the positioning mechanism 102 may be disposed over the opening the housing to provide the barrier when the implement 200 is in the retracted position 138. The flapper may be automatically opened responsive to an actuation of the push-button 124 (e.g. by a linkage).

Figure 3:
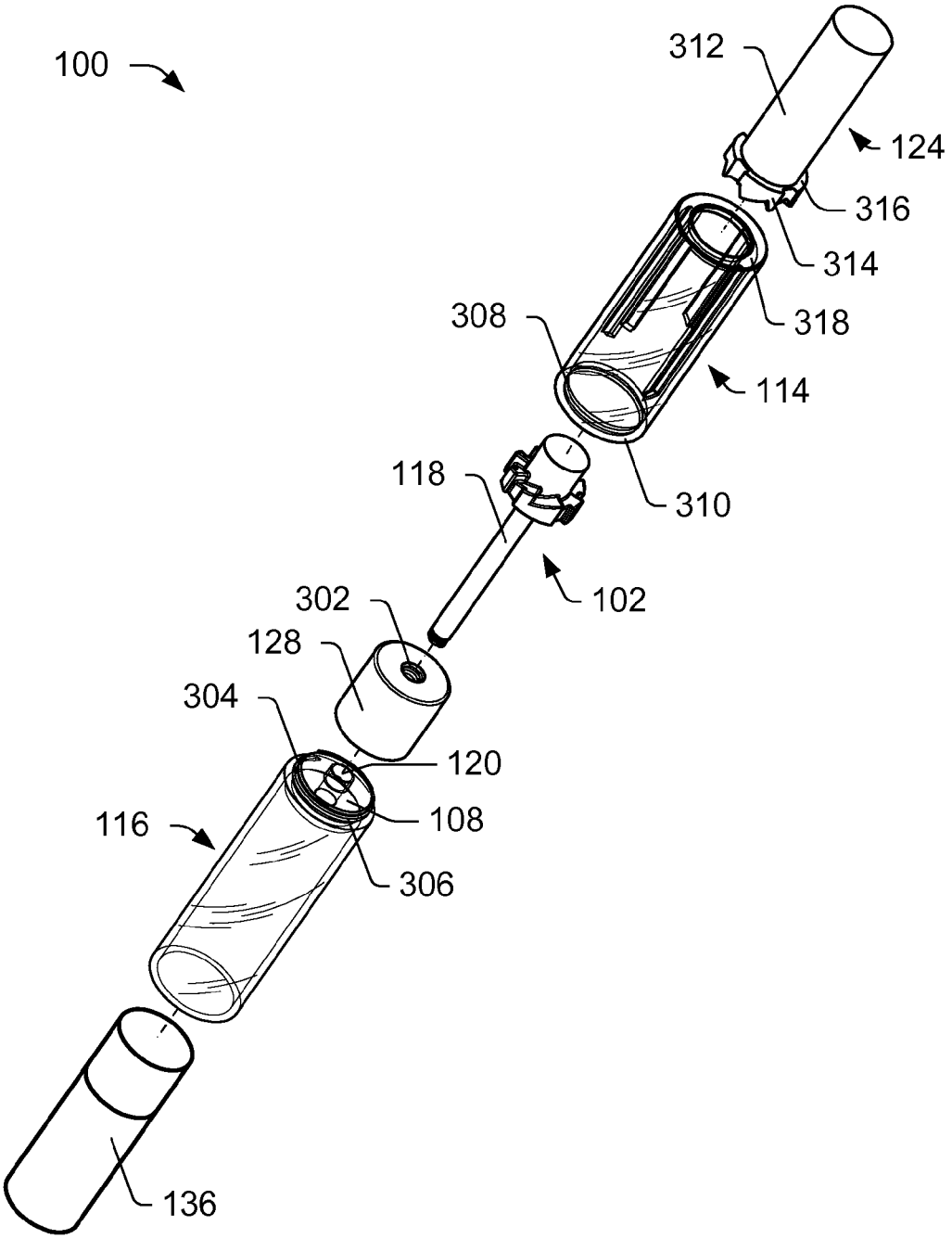
FIG. 3 is an exploded perspective view of the example retractable cosmetic implement of FIG. 1A.

FIG. 3 illustrates an exploded view of the example retractable implement 100. The implement 100 may comprise the push-button 124, the first chamber 114 of the housing 104, the second chamber 116 of the housing 104, the positioning mechanism 102, and the applicator 136.

The positioning mechanism 102 may comprise the ferrule 128 which may include a hole 302 with threading for receiving the shaft 118. During assembly, the ferrule 128 may be positioned in the second chamber 116 abutting the partition 108. The shaft 118 may be inserted through the aperture 120 on the partition 108, and mate with the hole 302. The shaft 118 may have a corresponding threading to permanently or semi-permanently couple the ferrule 128 to the shaft 118.

The second chamber 116 may comprise a threading 304 disposed around an end 306 configured to mate with a threading 308 around a corresponding end 310 of the first chamber 114. The first chamber 114 and the second chamber 116 may be coupled with an adhesive, snap-fit, friction, molding, welding, or any other method of coupling. The coupling of the first chamber 114 to the second chamber 116 may be permanent or semi-permanent. In some examples, the first chamber 114 and the second chamber 116 may be manufactured as a single unit.

The push-button 124 may comprise an elongated body 312 coupled to an engagement plate 314. The engagement plate 314 may include a shelf 316 to abut a stop rim 318 disposed around an inner edge of the first chamber 114, preventing the push-button 124 from fully exiting the housing 104.

In some embodiments, the push-button 124, the first chamber 114 of the housing 104, the second chamber 116 of the housing 104, and/or the positioning mechanism 102 may be comprised of a rigid or sem-rigid material such as polymer, metal, wood, ceramic, fiberglass, composites thereof, and/or combinations thereof. The push-button 124, the first chamber 114, the second chamber 116, and/or the positioning mechanism 102 may be comprised of the same material or of different materials. The push-button 124, the first chamber 114, the second chamber 116, and/or the positioning mechanism 102 may be comprised of a transparent material, a translucent material, an opaque material, and/or combinations thereof. Although, the push-button 124, the first chamber 114, the second chamber 116, and the positioning mechanism 102 are illustrated in FIG. 3 as comprising separately distinct units, any combination of these elements may be combined and/or manufactured as a single unit.

Figure 4A:
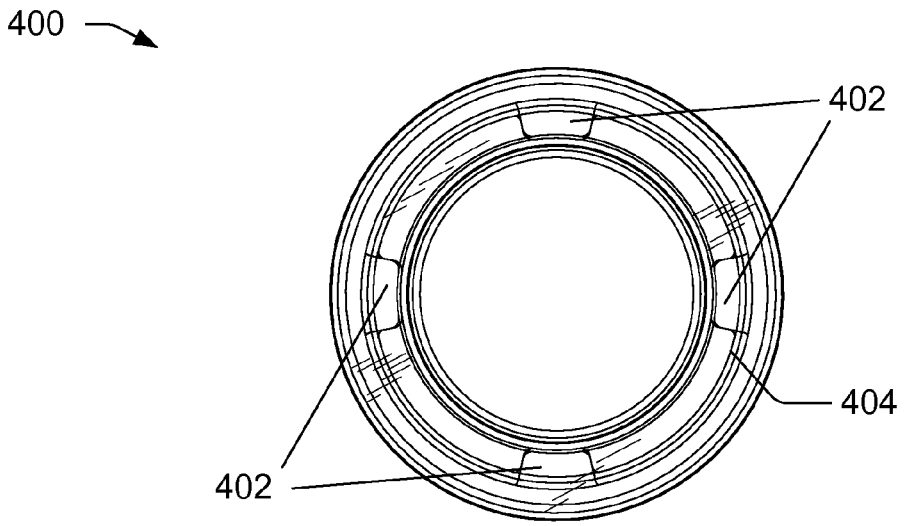
FIG. 4A is top view of the example retractable cosmetic implement of FIG. 1A.

FIG. 4A illustrates a top view of a cosmetic implement 400. Although the housing 104 of the cosmetic implement 400 illustrated in FIG. 4A is shown to be transparent for ease of understanding, some embodiments may comprise a housing 104 that is partially or fully opaque, translucent, transparent, or combinations thereof. In some examples, the engagement plate 314 on the push-button 124 may comprise a plurality of channels 402 disposed around an outer surface 404. In some examples, the plurality of channels 402 may comprise four channels evenly spaced 90° apart as measured from the center of the push-button 124. The plurality of channels 402 may be configured to mate with the plurality of guide rails 134 disposed on the internal surface 132 of the housing 104.

In some examples, the plurality of guide rails 134 may guide the push-button 124 when the push-button 124 is actuated by the downward force 206. The push-button 124 may slide along the guide rails 134 in a direction parallel to the longitudinal axis 106. The spring 130 may provide a resistant force to oppose the actuation force 206. The rim stop 318 may prevent the spring 130 from forcing the push-button 124 out of the housing 104. The push-button 124 may have a length dimension less than a length dimension of the guide rails 134, such that it cannot slide beyond the guide rails 134. In other words, the guide rails 134 may act like a keyway for the push-button 124, preventing it from rotating and limiting its motion to the single longitudinal direction. In some examples, the push-button 124 may not disengage the rail guides 134 at any point.

Figure 4B:
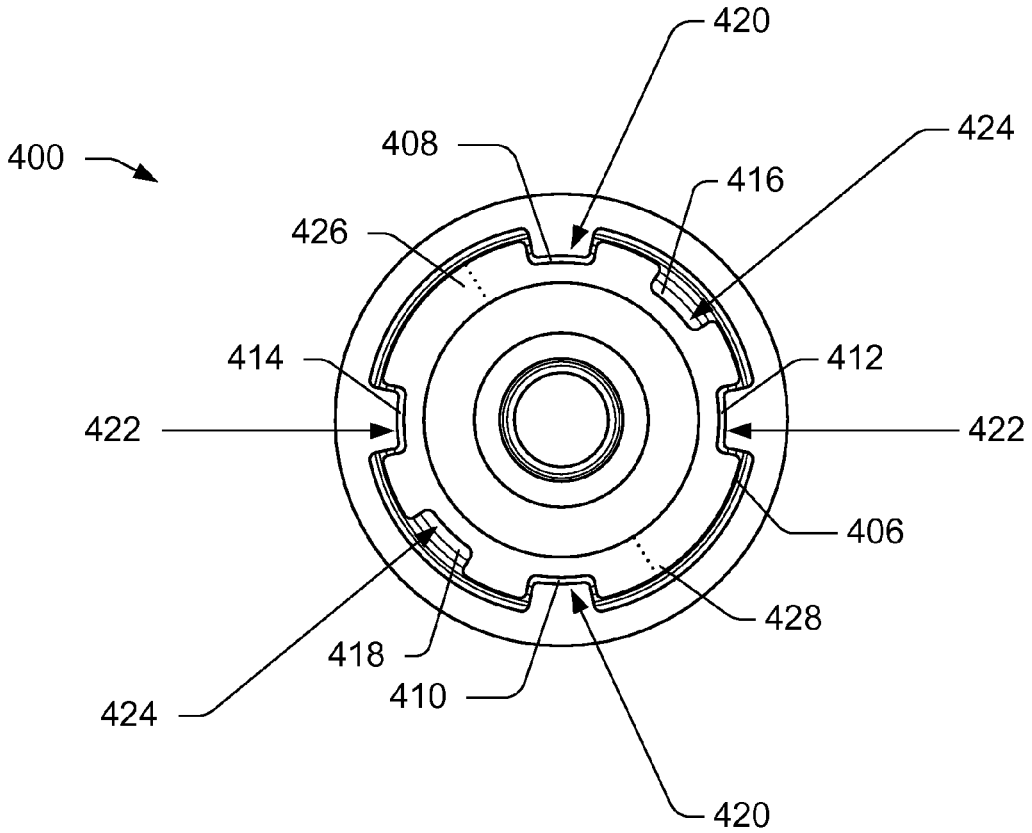
FIG. 4B is a top view of an example retractable cosmetic implement with a push-button omitted for illustrative purposes.

FIG. 4B shows a top view of the cosmetic implement 400 with the push-button 124 omitted for illustrative purposes, exposing a side surface 406 of the disk 122. The disk 122 may have a plurality of channels, described in greater detail below, running parallel to the longitudinal axis 106 formed into the side surface 406 for engaging the plurality of guide rails 134.

The side surface 406 may include a first channel 408, a second channel 410 disposed opposite the first channel 408, a third channel 412 disposed between the first and second channels 408 and 410, a fourth channel 414 disposed opposite the third channel 412 and between the first and second channels 408 and 410, a fifth channel 416 disposed between the first and third channels 408 and 412, and a sixth channel 418 disposed opposite the fifth channel 416 and between the second and fourth channels 410 and 414.

The first and second channels 408 and 410 may comprise a first set of channels 420, the third and fourth channels 412 and 414 may comprise a second set of channels 422, and the fifth and sixth channels 416 and 418 may comprise a third set of channels 424. In some embodiments, the side surface 406 may include a first stop surface 426 between the first channel 408 and the fourth channel 414 and a second stop surface 428 disposed opposite the first stop surface 426 and between the second and third channels 410 and 412.

Figure 5:
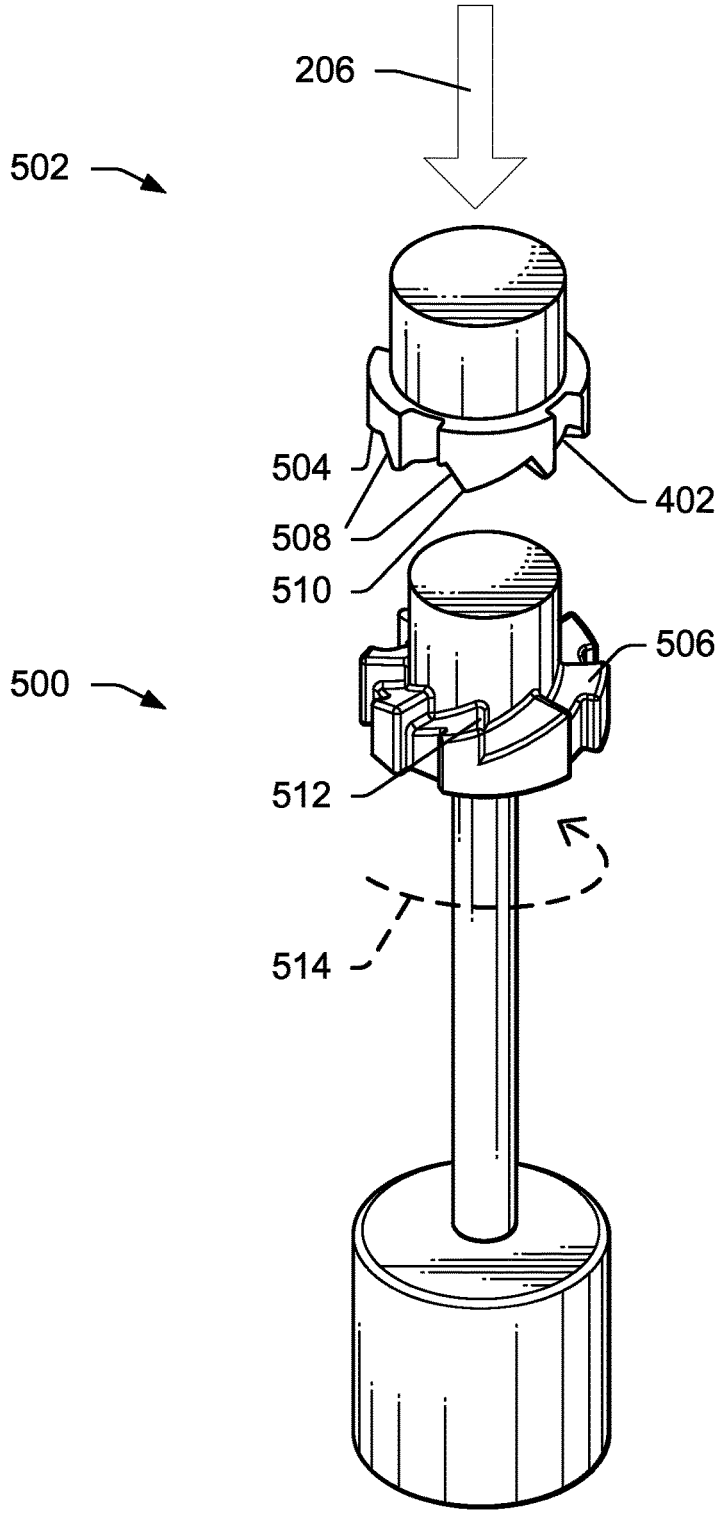
FIG. 5 is a perspective view of a push-button and a multi-stop positioning mechanism of an example retractable cosmetic implement.

FIG. 5 illustrates an example positioning-mechanism 500 and an example push-button 502. In some examples, the positioning mechanism 500 may be actuated when the downward force 206 is applied to the push-button 502, a bottom surface 504 of the push-button 502 engaging a top surface 506 of the disk 122. The bottom surface 504 may comprise a plurality of slopes 508 in a saw-tooth configuration, broken by the plurality of channels 402. In some examples, when the plurality of slopes 508 engages the top surface 506 of the disk 122, the plurality of channels 402 on the push-button 502 may align with at least one of the plurality of sets of channels 420, 422 and/or 424 via the guide rails 134.

In some embodiments, a point 510 on the bottom surface 504 of the push-button 502 may contact a peak 512 on the top surface 506 of the disk 122 when the push-button 502 is actuated. The point 510 may be slightly misaligned with the peak 512 such that a component of the force 206 is transmitted in a rotational direction 514. As the positioning mechanism 500 slides along the longitudinal axis 106, the guide rails 134 may prevent the positioning mechanism 500 from rotating. Similar to the click-pen mechanism of a retractable pen, the user may push the push-button 502 slightly past the extended position so that the top surface 506 of the disk 122 may clear the guide rails 134. Thus, the top surface 506 may slide past an end of the guide rails 134, so that the positioning mechanism 500 may be free to rotate. The guide rails 134 may have a slanted end to slide along the top surface 506 and engage at least one of the stop surfaces 426 and/or 428, locking the positioning mechanism 500 in the partially extended position 202 or the fully extended position 204, depending on a length of the set of guide rails 134 engaging the stop surfaces 426 and/or 428.

In some examples, the positioning mechanism 500 may be released from the partially extended position 202 or the fully extended position 204 by another actuation of the push-button 502. The push-button 502 may move the positioning mechanism 500 a length along the longitudinal axis 106 to release the end of the guide rails 134 from the stop surfaces 426 and/or 428. A component of the force 206 directed in the rotational direction 514 by the sloped configuration of the top surface 506 and the bottom surface 504 may rotate the disk 122 until a set of the plurality of guide rails 134 engage one of the sets of channels 420, 422, or 424 and provide a path for the positioning mechanism 500 to slide back to the retracted position 138.

In some embodiments, an actuation of the positioning mechanism 500 may comprise the push-button 502 moving only along the longitudinal axis 106, pushing the positioning mechanism 500 along the longitudinal axis 106 until it slides past an end of one of the plurality of guide rails 134 and rotates. The positioning mechanism 500 may be locked in the partially extended position 202 or the fully extended position 204 by the end of at least one of the plurality of guide rails 134 mating with one of the stop surfaces 426 and/or 428. A second actuation may cause the positioning mechanism 500 to release from the partially extended position 202 or the fully extended position 204 and rotate until all of the plurality of guide rails 134 are engaged with at least one of the sets of channels 420, 422, and/or 424, causing the positioning mechanism 500 to slide back to the retracted position 138. In the retracted position 138, the stop surfaces 426 and/or 428 may be disposed between the plurality of guide rails 134.

Figure 6A:
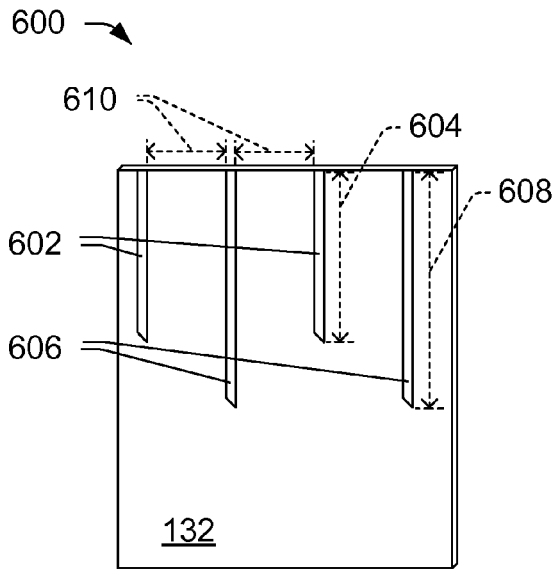
FIG. 6A is a schematic representation illustrating an example guide rail configuration of a retractable cosmetic implement comprising two sets of guide rails evenly and alternately spaced.
Figure 6B:
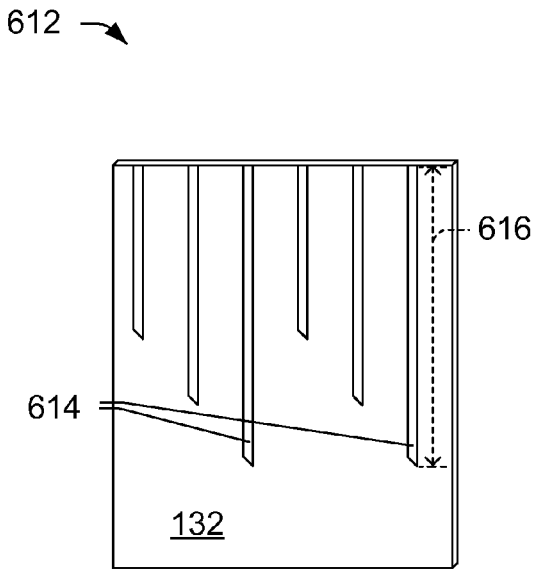
FIG. 6B is a schematic representation illustrating an example guide rail configuration of a retractable cosmetic implement comprising three sets of guide rails evenly and alternately spaced.
Figure 6C:
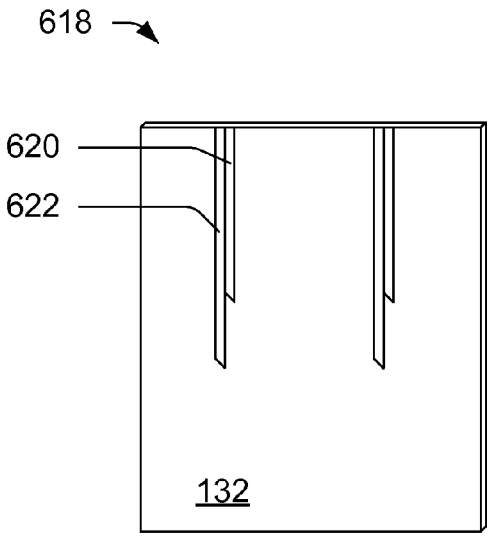
FIG. 6C is a schematic representation illustrating an example guide rail configuration of a retractable cosmetic implement comprising two sets of guide rails in an alternating, abutting arrangement.

FIGS. 6A-6C illustrate different possible guide rail configurations on the internal surface 132 of the housing 104. FIG. 6A illustrates a first guide rail configuration 600 which, in some examples, may comprise a first pair of guide rails 602 having a first length 604 and a second pair of guide rails 606 having a second length 608. In some embodiments, the guide rails of first pair 602 may alternate with the guide rails of the second pair 606. The alternating guide rails of the first and second pairs 602 and 604 may be evenly spaced apart by a plurality of gaps 610. In some embodiments, the second length 608 may be greater than the first length 604. When the ends of the first pair of guide rails 602 mate with the stop surfaces 426 and 428 of the disk 122, the implement 100 may be in the partially extended position 202. When the ends of the second pair of guide rails 606 mate with the stop surfaces 426 and 428 of the disk 122, the implement 100 may be in the fully extended position 204. When both pairs of guide rails 602 and 606 are received by one of the sets of channels 420, 422, and/or 424, the stops surfaces 426 and 428 may be disposed in the plurality of gaps 610 and the implement 100 may be in the retracted position 138.

FIG. 6B illustrates a second guide rail configuration 612. In some examples, configuration 612 may comprise the first set of guide rails 602, the second set of guide rails 606, and a third set of guide rails 614 with a third length 616. In some embodiments, the third length 616 may be greater than the first length 604 and the second length 608. The guide rails of each set 602, 606, and 614 may alternate and be spaced apart by the plurality of gaps 610 such that every other actuation of the push-button 124 causes the stop surfaces 426 and 428 to be disposed in the plurality of gaps 610 and the positioning mechanism 102 to slide back to the retracted position 138. In some examples, the first set of guide rails 602 may correspond to the first partially extended position 202, the second set of guide rails 606 may correspond to a second partially extended position (not shown), and the third set of guide rails 614 may correspond to the fully extended position 204.

Although three sets of guide rails 602, 606 and 614 corresponding to three extended positions are illustrated in FIG. 6B, some embodiments may include more than three sets of guide rails corresponding to more than three extended positions. For instance, configuration 612 may include a fourth set of guide rails corresponding to a fourth extended position. Any number of extended positions may be provided by varying the number of guide rail sets. In some examples, the material characteristic of the applicator 136 may have a number of states corresponding to the number of extended positions the positioning mechanism 102 may comprise. For instance, the applicator may comprise a brush with four positions corresponding to four sets of rail guides. In the first position, corresponding to the first set of rail guides, the brush may be relatively compact and firm. This material characteristic may be suitable for applying a cosmetic product for contouring. The material characteristic may incrementally and progressively change in response to moving the applicator from the first position, to the second position, to the third position, to the fourth position. In the fourth position, corresponding to the fourth set of guide rails, the brush may be expanded such that it is fluffier relative to the first, second, and third positions, making the brush more suitable for sheer applications such as loose powders.

FIG. 6C illustrates a third guide rail configuration 618. In some embodiments, configuration 618 may comprise the first set of guide rails 602 alternating with the second set of guide rails 606. In configuration 618, a first guide rail 620 of the first set 602 may be disposed adjacent to a second guide rail 622 of the second set 606 with no gap between the first guide rail 620 and the second guide rail 622. Additional guide rails from the first and second sets 602 and 606 may be disposed on the internal surface 132 in the same manner.

In some examples, a first actuation of the push-button 124 may slide the disk 122 longitudinally until the first set of guide rails 602 mates with the stop surfaces 426 and 428. A second actuation of the push-button 124 may release the disk 122 from the first set of guide rails 602, the disk 122 may rotate, and the disk 122 may slide back towards the push-button 124 until the second set of guide rails 606 mates with the stop surfaces 426 and 428. A third actuation of the push-button 124 may release the disk 122 from the second set of guide rails 606, the disk may rotate, and the disk may slide towards the first end 110 of the housing 104 until the positioning mechanism 102 has returned to the retracted position 138. In some embodiments, the positioning mechanism 102 may be moved to the partially extended position 202 and the fully extended position 204 without returning to the retracted position 138 between the partially extended position 202 and the fully extended position 204.

The foregoing examples describe a retractable cosmetic implement having an applicator movable between multiple positions. The cosmetic implement allows a single brush to replicate the functionality of multiple brushes by having a different material characteristic in each position. The cosmetic implement also provides substantial protection to the applicator when it is retracted into the housing without requiring a cap.

Conclusion

Although this disclosure uses language specific to structural features and/or methodological acts, it is to be understood that the scope of the disclosure is not necessarily limited to the specific features or acts described. Rather, the specific features and acts are disclosed as illustrative forms of implementation.

What is claimed is:

1. A cosmetic implement comprising:

a housing extending a length along a longitudinal axis;

an applicator disposed at a first end of the housing; and a multi-stop positioning mechanism disposed at least partially in the housing with a shaft extending along the longitudinal axis inside the housing, the shaft coupling to the applicator, the applicator being positionable inside the housing, outside the housing, and partially outside the housing in response to a plurality of actuations of the multi-stop positioning mechanism configured to move the multi-stop positioning mechanism between a plurality of indexed positions, each indexed position of the plurality of indexed positions corresponding to a position of the applicator inside the housing, outside the housing or partially outside the housing wherein the multi-stop positioning mechanism comprises a disk having a top surface and multiple teeth extending from a perimeter of the disk parallel to a central axis of the disk configured to engage a push-button.

2. The cosmetic implement of claim 1, wherein the applicator is positionable outside the housing or partially outside the housing by extending in a direction along the longitudinal axis through an opening on the first end of the housing.

3. The cosmetic implement of claim 1, wherein the applicator comprises a characteristic that is dependent at least in part upon a position of the applicator relative to the housing.

4. The cosmetic implement of claim 3, wherein the applicator comprises a plurality of bristles and the characteristic comprises a compactness or density of the plurality of bristles.

5. The cosmetic implement of claim 1, wherein the applicator comprises a characteristic that changes responsive to movement of the applicator from a first position relative to the housing to a second position relative to the housing.

6. The cosmetic implement of claim 1, wherein the push-button extends from a second end of the housing opposite the first end.

7. The cosmetic implement of claim 1, wherein the push-button is compressible a first length to move the applicator a second length, the first and second lengths being substantially equal.

8. A cosmetic implement comprising:

a housing extending a length along a longitudinal axis;

an applicator disposed at a first end of the housing; and a multi-stop positioning mechanism disposed at least partially in the housing with a shaft extending along the longitudinal axis inside the housing, the shaft coupling to the applicator, the applicator being positionable inside the housing, outside the housing, and partially outside the housing in response to a plurality of actuations of the multi-stop positioning mechanism configured to move the multi-stop positioning mechanism between a plurality of indexed positions, each indexed position of the plurality of indexed positions corresponding to a position of the applicator inside the housing, outside the housing or partially outside the housing wherein the multi-stop positioning mechanism comprises a circular disk with a side surface disposed around a perimeter of the disk, the side surface having a plurality of channels extending parallel to a central axis of the disk configured to engage a plurality of guide rails disposed on an internal surface of the housing.

9. The cosmetic implement of claim 8, wherein the plurality of channels comprises:

a first channel;

a second channel disposed opposite the first channel;

a third channel interposed between the first and second channels;

a fourth channel disposed opposite the third channel and interposed between the first and second channels;

a fifth channel interposed between the first and fourth channels; and a sixth channel disposed opposite the fifth channel and interposed between the second and third channels.

10. The cosmetic implement of claim 8, wherein the plurality of guide rails comprises a first set of rails and a second set of rails interposed between the first set of rails, the second set of rails having a length dimension different than a length dimension of the first set of rails.

11. The cosmetic implement of claim 8, wherein the disk comprises a slanted shelf disposed on a top surface of the disk configured to receive an end of one of the plurality of guide rails when the multi-stop positioning mechanism is in an extended or partially extended position.

12. A retractable brush comprising:

an elongated housing with an opening at a first end; and an applicator coupled to a positioning mechanism within the housing, the applicator being movable to one of a plurality of predefined positions in response to an actuation of the positioning mechanism, the plurality of positions comprising:

a first position in which the applicator is retracted within the housing;

a second position in which the applicator is extended through the opening; and a third position in which the applicator is extended through the opening, the applicator extending a greater distance in the second position than in the third position wherein the positioning mechanism comprises a click-pen mechanism having multiple indexed positions corresponding at least to the first position, second position, and third position of the applicator.

13. The retractable brush of claim 12, wherein the positioning mechanism slides within the housing when actuated.

14. The retractable brush of claim 12, wherein the applicator comprises a plurality of bristles with a compactness responsive to an extension of the applicator through the opening.

15. The retractable brush of claim 12, wherein the applicator has a first width in the second position and a second width in the third position, the first width being greater than the second width.

16. A retractable brush comprising:

an elongated housing with an opening at a first end; and an applicator coupled to a positioning mechanism within the housing, the applicator being movable to one of a plurality of predefined positions in response to an actuation of the positioning mechanism, the plurality of positions comprising:

a first position in which the applicator is retracted within the housing;

a second position in which the applicator is extended through the opening; and a third position in which the applicator is extended through the opening, the applicator extending a greater distance in the second position than in the third position;

wherein the positioning mechanism comprises a button extending from a second end of the housing engaged with a top surface of a toothed disk coupled to the applicator via a shaft;

further comprising a spring in contact with the positioning mechanism to provide a resistance against the button during one of the plurality of actuations, the resistance returning the button to a resting position after each of the plurality of actuations.

17. A retractable cosmetic implement comprising:

a positioning mechanism including a disk coupled to a first end of a shaft and a ferrule coupled to a second end of the shaft;

a housing enclosing the positioning mechanism, the housing having an opening proximal to the second end of the shaft;

an applicator coupled to the ferrule that moves through the opening in response to an actuation of the positioning mechanism; and a rim of the opening contacting and applying a pressure to an outer boundary of the applicator where the applicator exits the opening.

18. The retractable cosmetic implement of claim 17, further comprising a button disposed at a distal end of the housing opposite the opening, the button having a bottom surface engaging a plurality of teeth on a top surface of the disk.

19. The retractable cosmetic implement of claim 17, wherein the contact provided by the rim of the opening at least partially compacts the applicator when the applicator is partially extended through the opening.

20. The retractable cosmetic implement of claim 17, wherein the applicator comprises:

a plurality of natural bristles;

a plurality of synthetic bristles;

a flocking;

a silicone member; or a sponge.

21. The retractable brush of claim 17, wherein the applicator is maintained in a position by the positioning mechanism, a length of the position relative to the housing determined at least in part by a configuration of a plurality of guide rails disposed on an internal surface of the housing.

* * * * *